US006752294B2

(12) United States Patent
Osti et al.

(10) Patent No.: US 6,752,294 B2
(45) Date of Patent: Jun. 22, 2004

(54) DEVICE FOR MOUNTING AN ITEM

(75) Inventors: Alois Osti, Cranford, NJ (US); Yannick Renaudin, Marolles les Braults (FR)

(73) Assignee: L'Oreal, SA, Paris (FR)

( * ) Notice: Subject to any disclaimer, the term of this patent is extended or adjusted under 35 U.S.C. 154(b) by 0 days.

(21) Appl. No.: 09/925,727

(22) Filed: Aug. 10, 2001

(65) Prior Publication Data

US 2003/0029886 A1 Feb. 13, 2003

(51) Int. Cl.[7] ..... B67D 1/07

(52) U.S. Cl. ..... 222/192; 222/321.7; 63/26; 63/29.1

(58) Field of Search ..... 222/78, 192, 321.7; 63/1.11, 1.12, 1.44, 26, 27, 29.1, 31; D11/2, 91

(56) References Cited

U.S. PATENT DOCUMENTS

| | | | | |
|---|---|---|---|---|
| 5,432,988 A | * | 7/1995 | Woo | 29/10 |
| 5,992,177 A | * | 11/1999 | Beard | 63/29.1 |
| 6,067,818 A | * | 5/2000 | Winkler | 63/26 |
| 6,116,054 A | * | 9/2000 | Czupor | 63/26 |
| 6,364,167 B1 | * | 4/2002 | Safian et al. | 222/153.13 |
| 6,467,308 B2 | * | 10/2002 | Butler | 63/26 |

FOREIGN PATENT DOCUMENTS

| | | | |
|---|---|---|---|
| EP | 0 645 104 A1 | | 3/1995 |
| FR | 2722379 | * | 1/1996 |
| FR | 2 725 882 | | 4/1996 |
| GB | 841565 | | 7/1960 |

OTHER PUBLICATIONS

Derwent Abstract of FR 2 725 882, Apr. 1996.

* cited by examiner

*Primary Examiner*—Joseph A. Kaufman
(74) *Attorney, Agent, or Firm*—Finnegan, Henderson, Farabow, Garrett & Dunner LLP

(57) ABSTRACT

A device for mounting an item may comprise a first member having a portion defining at least one opening extending through the first member and a second member intended to be fixed beneath the first member. A plurality of mounting members may be associated with the second member. The plurality of mounting members and the portion of the first member may be configured to sandwich an item between the plurality of mounting members and the portion of the first member defining the at least one opening. The item may be arranged to be visible from an exterior of the device. The device could be associated with a container containing a product.

160 Claims, 9 Drawing Sheets

DEVICE FOR MOUNTING AN ITEM

The invention relates generally to a mounting device and, more particularly, to a device for mounting an item, for example, an ornamental object, such as a natural or synthetic stone or the like.

Conventionally, ornaments may be attached to articles, for example, those relating to jewelry, by an adhesive or by a threaded connection. In either case, the article typically includes a recess configured to receive the ornament.

Another conventional mounting configuration includes a recess configured to receive an ornament and a retaining lip surrounding an opening leading to the recess. The lip may be resilient such that it may deform in an outward direction with respect to the recess as an ornament is inserted into the recess. Once the ornament is positioned in the recess, the lip returns toward its original, non-deformed position. The lip may have a free end extending substantially toward the recess and over a portion of the ornament located opposite to the bottom of the recess, thereby holding the ornament in the recess.

In these and other conventional mounting configurations, the recess typically has a shape complementary to that of the ornament, and the portion of the ornament contacting the mounting may be completely surrounded by the mounting. As a result, the brilliance of an ornament may be reduced when light passes through the ornament and becomes blocked by a surface defining the recess. Such a reduction in brilliance could significantly diminish the aesthetic appearance of a number of very decorative ornaments, such as jewels or facsimiles of jewels. In addition, these conventional mounting configurations may be messy, cumbersome or otherwise difficult to assemble, and/or unreliable.

According to one optional aspect of the invention, a device for mounting an item may comprise a first member having a portion defining at least one opening extending through the first member and a second member intended to be fixed beneath the first member. A plurality of mounting members may be associated with the second member. The plurality of mounting members and the portion of the first member may be configured to sandwich an item between the plurality of mounting members and the portion of the first member defining the at least one opening. The item may be arranged to be visible from an exterior of the device.

According to another optional aspect, a device for mounting an item may comprise a first member comprising a portion defining at least one opening extending through the first member and a plurality of mounting members intended to be fixed beneath the first member. The plurality of mounting members may be spaced from one another. The plurality of mounting members and the portion of the first member may be configured to sandwich an item between the plurality of mounting members and the portion of the first member such that at least a portion of the item is arranged to be visible from an exterior of the device.

Optionally, the plurality of mounting members may extend from the portion of the first member defining the opening and have a free end. Alternatively, the device may comprise a second member, and the plurality of mounting members may be associated with the second member. For example, the plurality of mounting members may be integrally formed with the second member, or the plurality of mounting members may be formed separate from the second member and sandwiched between the second member and the item.

Optionally, the second member may comprise a portion defining a second opening, which may be substantially aligned with the opening defined by the first member. The first member may comprise an outer surface and an inner surface, and at least a portion of the opening defined by the first member may taper in a direction facing from the inner surface to the outer surface, thereby defining a seat facing the second member.

According to an optional aspect, the plurality of mounting members may define a cradle that cooperates with the seat to define a region and to sandwich an item in the region. The plurality of mounting members may comprise at least three flexible fingers. Each of the flexible fingers may comprise a first portion extending from the second member toward the first member and a second portion extending from the first portion. The second portion may also have a free end. The second portion of each of the flexible fingers may extend substantially toward the second opening.

According to another optional aspect, an arrangement may comprise a device in accordance with the invention. The arrangement may also comprise an item configured to be sandwiched between the plurality of mounting members and the portion of the first member defining the opening. The plurality of mounting members may bias the item toward the opening defined by the first member.

Optionally, a portion of the item may extend at least partially through the opening defined by the first member. The portion of the item extending through the opening may be visible from the exterior of the device. A further portion of the item might also be visible from the exterior, for example, via the opening. The item may comprise a jewel, such as a natural stone, or a facsimile of a jewel, such as a synthetic stone, for example, a cubic zirconium. The item may be configured in any shape, for example, a sphere, a cube, an ellipsoid, a brilliant-cut diamond shape, an emerald-cut diamond shape, a princess-cut diamond shape, a marquis-cut diamond shape, a pear-cut diamond shape or the like.

Optionally, the arrangement may comprise a closure member for a container, for example, a cap, a stopper, or the like. Where the closure member is configured as a cap, the first member may comprise an outer cap portion and the second member may comprise an inner cap portion. The inner cap portion may be configured to be insertably mounted in the outer cap portion. The outer cap portion and the inner cap portion may be connected in any known manner, for example, by an interference fit, an adhesive, a threaded connection, or the like.

Alternatively, the arrangement may comprise a cover configured to at least partially cover a container. In such an arrangement, the first member may comprise an outer sleeve, and the second member may comprise an inner sleeve. The outer sleeve may be configured to at least partially surround the inner sleeve.

According to an optional aspect of the invention, an apparatus may comprise the aforementioned arrangement associated with a container configured to contain a product. The apparatus may include a product, for example, a cosmetic product, a care product, or the like, in the container. Optionally, the product may comprise a fragrance. For example, the product could be in the form of a perfume, cologne, after shave, scented skin lotion, and/or scented hair product.

According to an optional aspect, the container may comprise a pump. One of the exemplary arrangements may be configured to cover an outlet of the pump and/or a push-button or other form of actuator of the pump. Alternatively, the arrangement may be configured as a stopper intended to be removably received by a portion the container defining an outlet.

According to another optional aspect of the invention, a closure member for a container may comprise an outer member defining at least one seat and at least one opening and an inner member defining at least one cradle. The cradle and the seat may cooperate to define a region, and an item may be mounted in the region defined by the seat and the cradle.

According to one optional aspect, the item may be visible from a side of the outer member opposite to the inner member. The outer member may comprise an outer surface and an inner surface, and at least a portion of the opening may taper in a direction facing from the inner surface to the outer surface, thereby forming the seat.

According to another optional aspect, the item may comprise a maximum width dimension greater than a minimum width dimension of the opening defined by the first member. For example, a circle circumscribing a maximum width portion of the item may be greater than a circle circumscribing a minimum width portion of the opening. The item may comprise a maximum width dimension less than a width dimension of the opening at the inner surface of the first member.

Optionally, the closure member may be configured, for example, as a cap, a stopper, or the like. The outer member may comprise an outer cap portion and the inner member may comprise an inner cap portion. The inner cap portion may be configured to be mounted in the outer cap portion.

According to an optional aspect, an apparatus may comprise the closure member and a container configured to contain a product.

According to another optional aspect of the invention, a product dispensing assembly may comprise a container configured to contain a product and a portion associated with the container. The portion may comprise a first member defining at least one seat and at least one opening and a second member defining at least one cradle. An item may be mounted in a region defined by the cradle and the seat.

According to one optional aspect, the second member may define a second opening substantially aligned with the opening defined by the first member. Optionally, the second member may be fixed beneath the first member.

According to another optional aspect, the portion may comprise a closure member for the container.

According to yet another optional aspect, the portion of the assembly may form a portion of the container. For example, the portion of the assembly may be configured as a cover configured to at least partially cover a part of the container defining a product reservoir. Optionally, the first member may comprise an outer sleeve, and the second member may comprise an inner sleeve. The outer sleeve may be configured to at least partially surround the inner sleeve.

According to yet another optional aspect of the invention, a product dispensing assembly may comprise a container and a cosmetic product contained in the container. The assembly may also include a cap comprising an outer member and an inner member. The cap may be associated with the container. An item may be sandwiched between the outer member and the inner member. A portion of the item may be visible from an exterior of the assembly.

It is to be understood that both the foregoing general description and the following detailed description are exemplary and explanatory only and are not restrictive of the invention, as claimed.

The accompanying drawings, which are incorporated in and constitute a part of this specification, illustrate exemplary embodiments of the invention and, together with the description, serve to explain some of the principles of the invention. In the drawings, FIG. 1 is a perspective view of a container associated with a mounting arrangement in accordance with an exemplary embodiment of the present invention;

Reference will now be made in detail to embodiments of the invention, examples of which are illustrated in the accompanying drawings.

Figure 1:
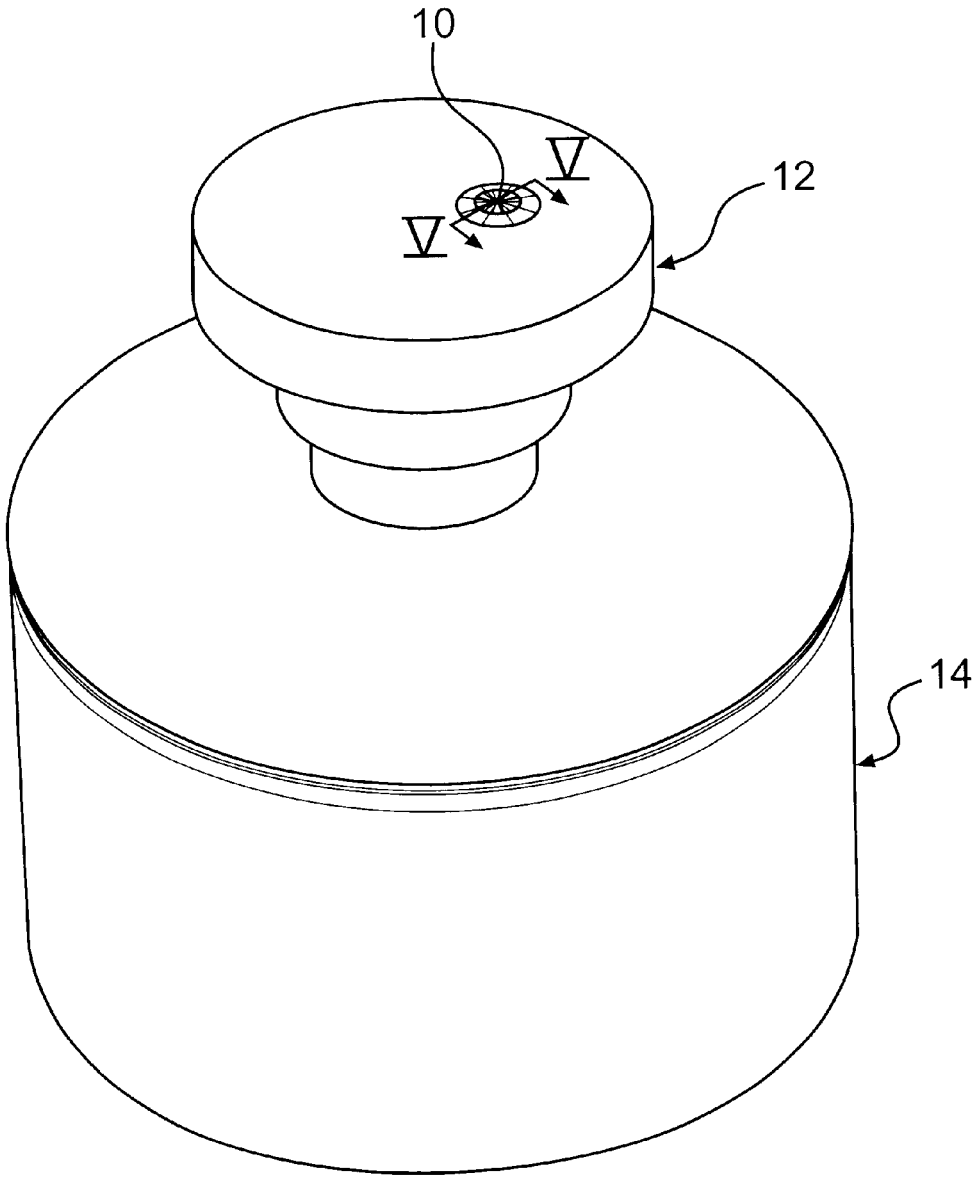

In accordance with the present invention, a device for mounting an item is provided. Referring to FIG. 1, an item 10, such as an ornamental object, may be mounted on a closure member 12 configured in the form of a cap, for example, associated with a container 14. The container 14 may define a product reservoir 16, which may contain, for example, a cosmetic product, a care product, or the like, optionally including a fragrance. For example, the container 14 may be configured as a bottle, as shown in FIG. 1. It should be appreciated that the container 14 may alternatively be configured as a jar, a tube, a compact, or any known device capable of containing a cosmetic product, a care product, or the like. The container 14 may be formed of any material, such as glass, plastic, or the like arranged in a one-piece or multiple-piece configuration.

Referring to FIGS. 2–5, the closure member 12 includes a device 20 for mounting the item 10. The device 20 may include a first member 22 and a second member 24 configured in the form of an outer cap portion and a lower cap portion, respectively. The first member 22 may include a portion 26 defining at least one opening 28 extending through the first member 22. The second member 24 may be configured to be fixed beneath the first member 22. For example, an outer cylindrical surface of the second member 24 could be insertably mounted by an interference (i.e., friction) fit connection within an inner cylindrical surface of the first member 22. Alternatively, any other form of known connection or coupling could be used, such as adhesive, threading, or the like. Ledges 25 may be provided on the top of the second member 24 to mate with a lower inner surface of the first member 22 and thereby space center portions of the first and second members 22 and 24 from one another.

Figure 5:
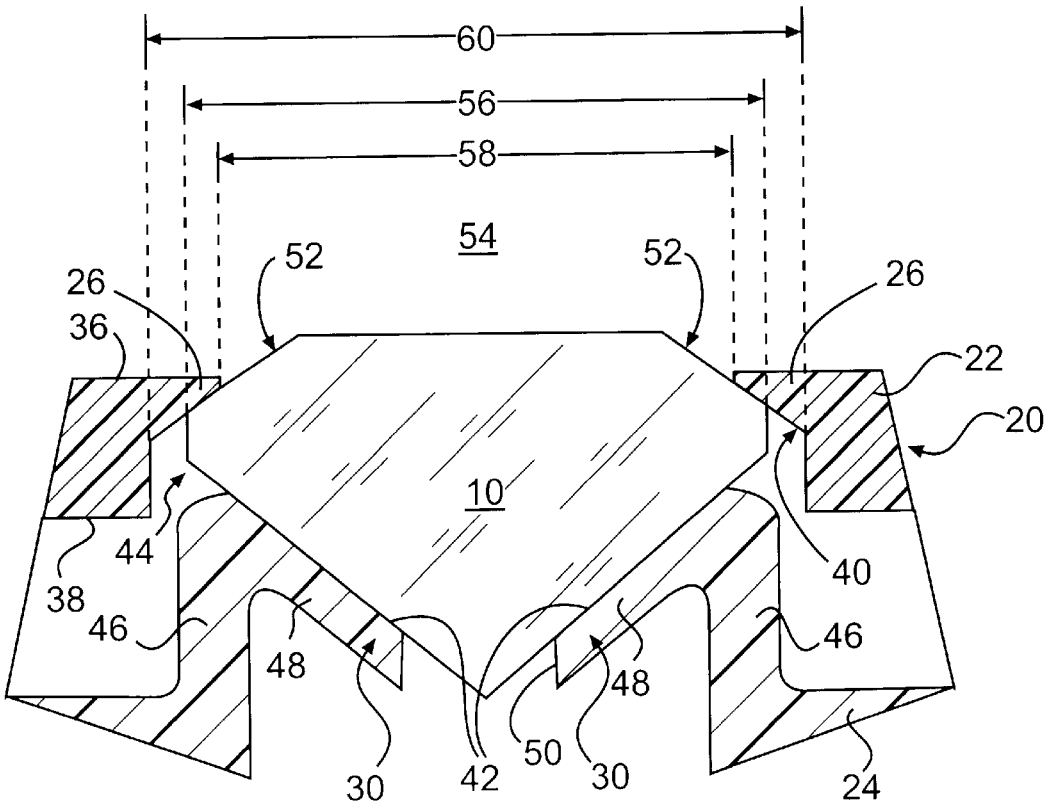
FIG. 5 is a cross-sectional view along line V—V of FIG. 1.

A plurality of mounting members 30 may be associated with the second member 24. As shown in FIG. 5, the plurality of mounting members 30 and the portion 26 of the first member may be configured to sandwich the item 10. A portion 52 of the item 10 may extend partially from the opening so that it is visible from an exterior 54 of the closure member 12. In the exemplary embodiment shown in FIG. 5, the item 10 is a substantially transparent or substantially translucent cubic zirconium enabling at least a portion of the item 10 to be visible via the opening 28.

The second member 24 may comprise a portion 32 defining a second opening 34, which may be substantially aligned with the opening 28 defined by the first member 22. The first member 22 may comprise an outer surface 36 and an inner surface 38. At least a portion of the opening 28 defined by the first member 22 may taper in a direction facing from the inner surface 38 toward the outer surface 36, thereby defining a seat 40 facing the second member 24.

The mounting members 30 may define a cradle 42 that cooperates with the seat 40 to define a region 44 where the item 10 may be mounted. The mounting members 30 may bias the item 10 toward the opening 28 and the seat 40 when the item 10 is sandwiched in the region 44. Although the embodiment shown in FIGS. 2–5 includes four mounting members 30, three mounting members or even more than four mounting members may perform equally well.

Figure 3:
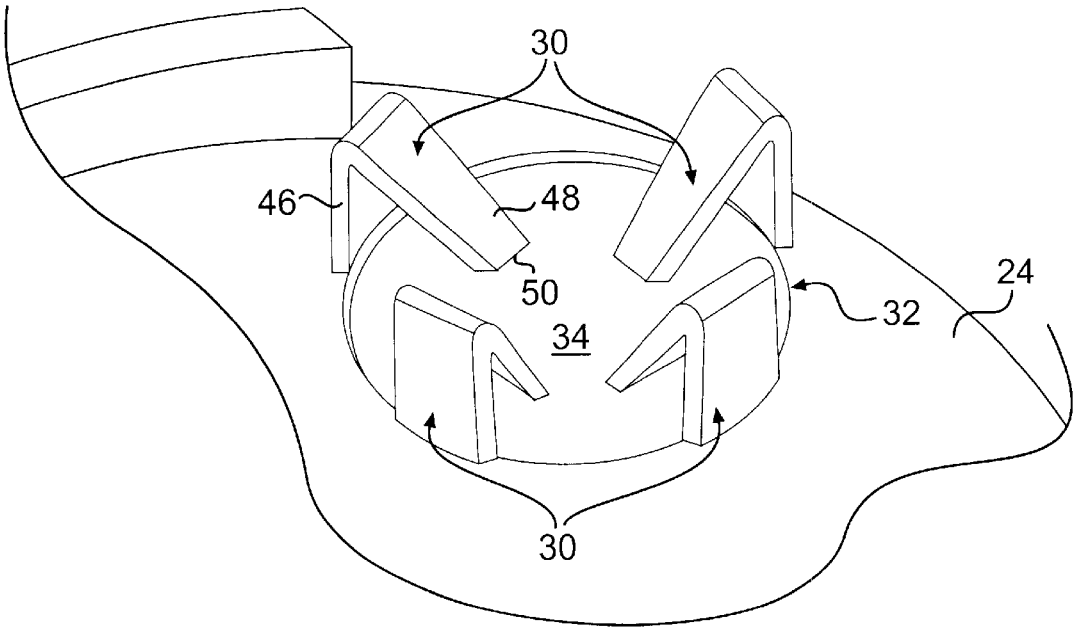
FIG. 3 is a perspective view of a portion of a mounting device provided on the cap of FIG. 2.
Figure 4:
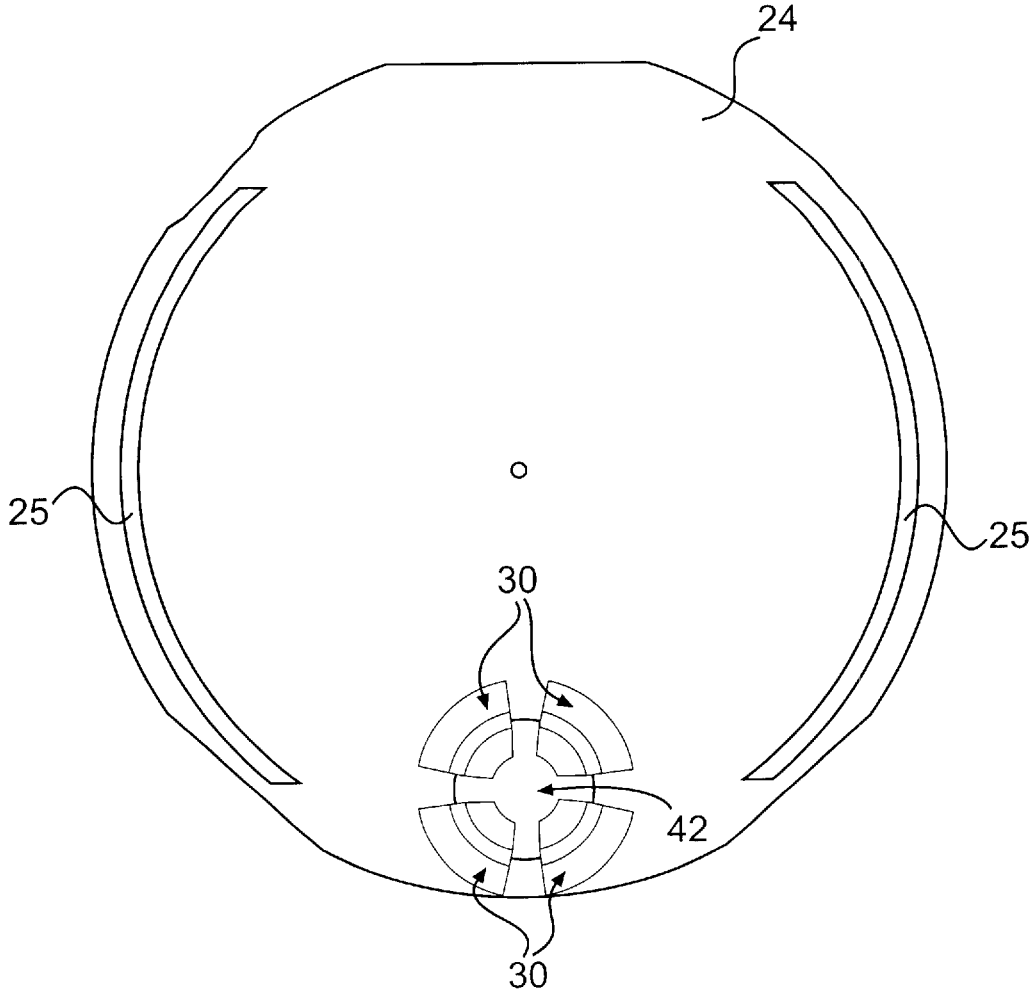
FIG. 4 is a top view of an inner portion of the cap of FIG. 2.

Referring to FIGS. 3 and 5, each of the mounting members 30 may comprise a flexible finger including a first portion 46 extending from the second member 24 toward the first member 22. A second portion 48 of each mounting members 30 may extend from the first portion 46 toward the second opening 34 and have a free end 50. The first and second portions 46, 48 may be joined to one another at an elbow defining an angle of less that 90 degrees. There are numerous possible alternative arrangements for the mounting members 30. Certain alternative arrangements might even lack such members.

The item 10 may have a maximum width dimension 56 greater than a minimum width dimension 58 of the opening 28 defined by the first member 22 so that the seat 40 maintains at least a portion of the item 10 with the first member 22. The maximum width dimension 56 may be less than a width dimension 60 of the opening 28 at the inner surface 38 of the first member 22.

As mentioned above, the item 10 shown in FIG. 5 is a cubic zirconium. Alternatively, the item 10 may comprise any other type of a facsimile of a jewel or a synthetic stone, or even an actual a jewel or natural stone. The item 10 shown in FIG. 5 has a brilliant-cut diamond shape, but there are many possible alternative shapes, for example, a sphere, a cube, an ellipsoid, an emerald-cut diamond shape, a princess-cut diamond shape, a marquis-cut diamond shape, a pear-cut diamond shape, and the like.

Figure 2:
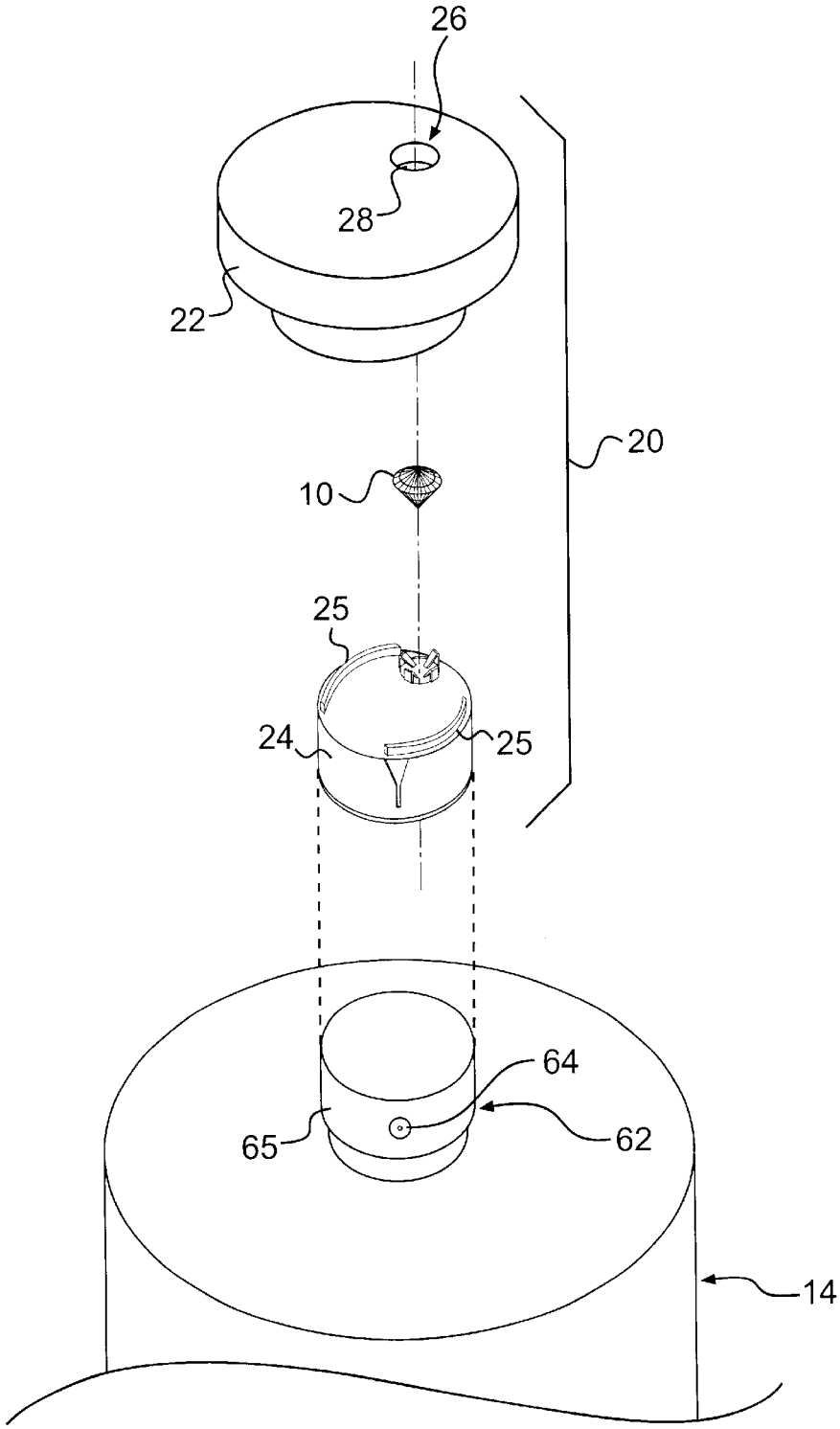
FIG. 2 is an exploded view of a cap and top portion of the container shown in FIG. 1.

According to the exemplary embodiment of FIGS. 1–5, the container 14 may be configured as a product dispensing assembly, for example, an assembly that includes a pump 62. Referring to FIG. 2, the device 20 may be configured as a closure member, for example, a cap, to cover an outlet 64 of the pump 62 and optionally also (or alternatively) to cover a portion of the pump 62 defining an actuator 65 such as a push-button actuator. Optionally, a dip tube (not shown) might extend in the container 14 and be in flow communication with the pump 62. Alternatively, the device 20 may be configured as a cap to cover an outlet and/or actuator of a container 14 that does not include a pump. For example, in an alternative embodiment, the device 20 may be configured as a cap to cover at least a valve actuator for a container containing a pressurized product (e.g., the pump 62 shown in FIG. 2 could be replaced with a valve having an actuator, such as a push-button actuator).

Figure 6:
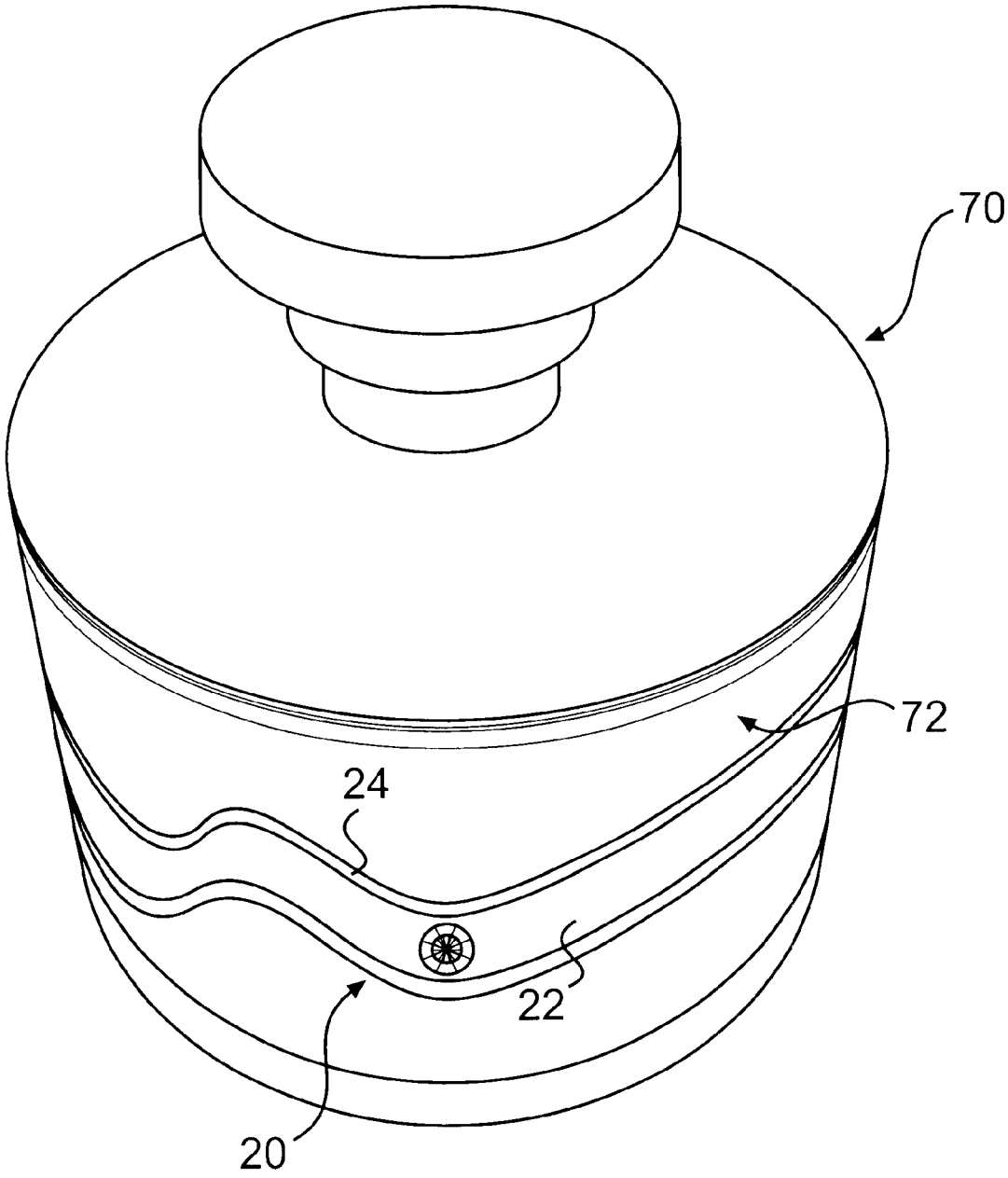
FIG. 6 is a perspective view of a container and associated mounting arrangement in accordance with another exemplary embodiment of the present invention.

Referring to FIG. 6, the mounting device 20 may comprise a portion of an arrangement 70 configured in the form of a cover 72 at least partially covering a container 14. In this arrangement, the first member 22 may comprise an outer sleeve and the second member 24 may comprise an inner sleeve. The outer sleeve may at least partially surround the inner sleeve, while the inner sleeve may at least partially surround the portion of the container 14 defining a product reservoir 72.

Figure 7:
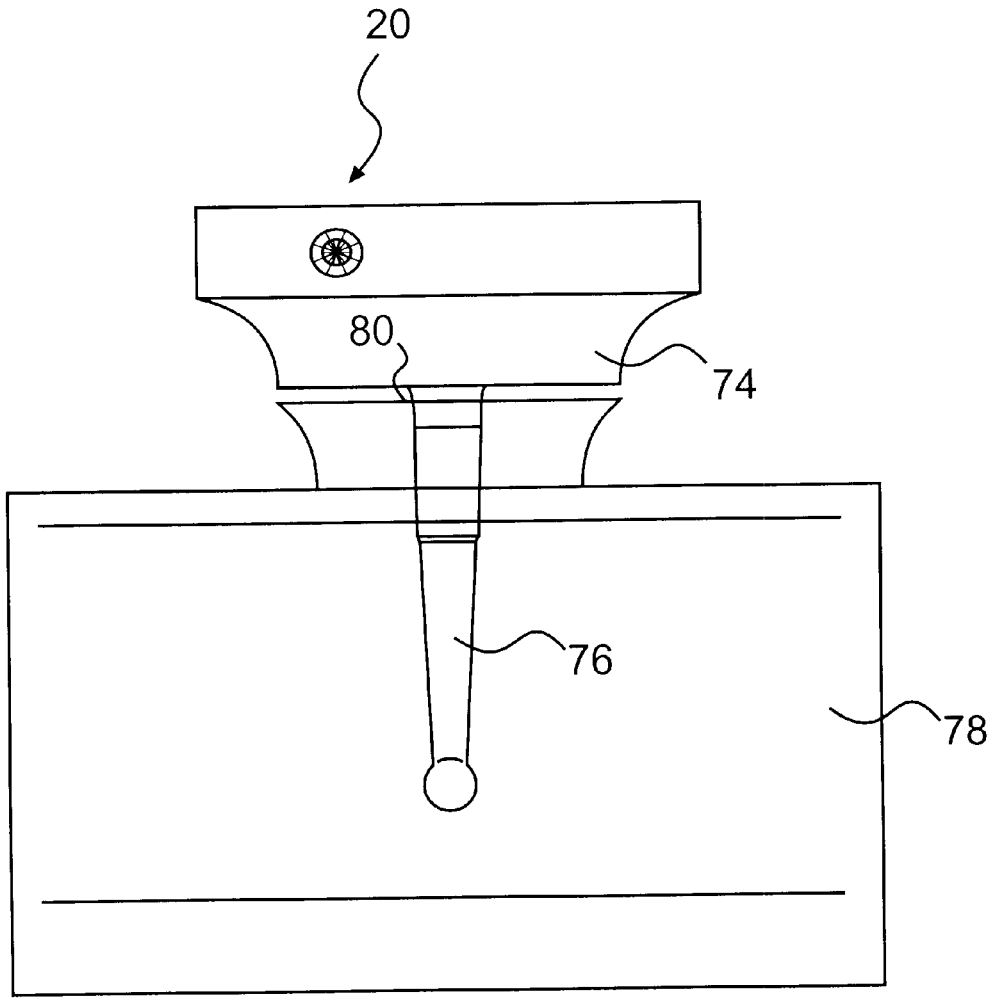
FIG. 7 is a side view of a container and associated mounting arrangement in accordance with yet another exemplary embodiment of the present invention.

Referring to FIG. 7, the mounting device 20 may also be configured as a portion of a closure member configured in the form of a stopper 74, optionally having a dabber 76, for example, a glass dabber. The stopper 74 may be removably inserted into a container 78 to close an outlet 80 of the container 78.

Figure 8:
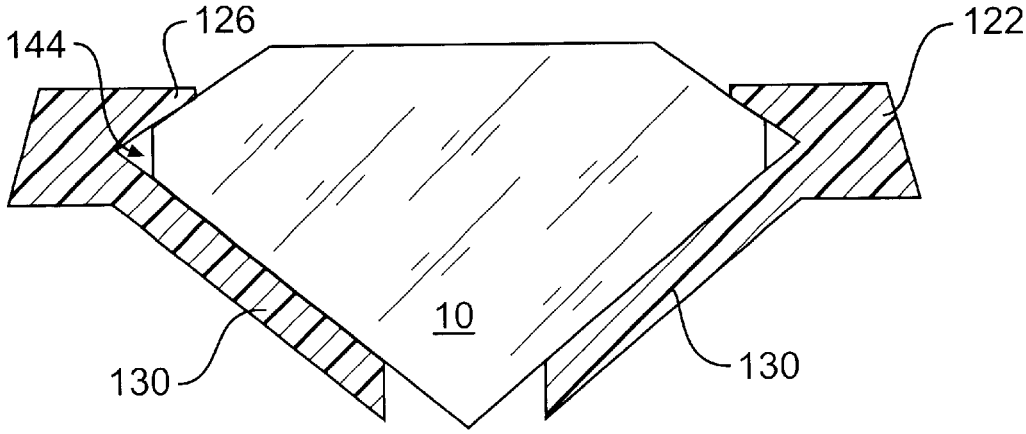
FIG. 8 is a cross-sectional view of another exemplary embodiment of the present invention.

FIG. 8 shows an alternative exemplary embodiment, wherein a plurality of mounting members 130 are integral with (or connected to) a first member 122. The plurality of mounting members 130 and a portion 126 of the first member 122 may be configured to sandwich the item 10. The plurality of mounting members 130 and/or the portion 126 may be formed of a material capable of flexing to permit the item 10 to be inserted in a region 144 located between the plurality of mounting members 130 and the portion 126.

Figure 9:
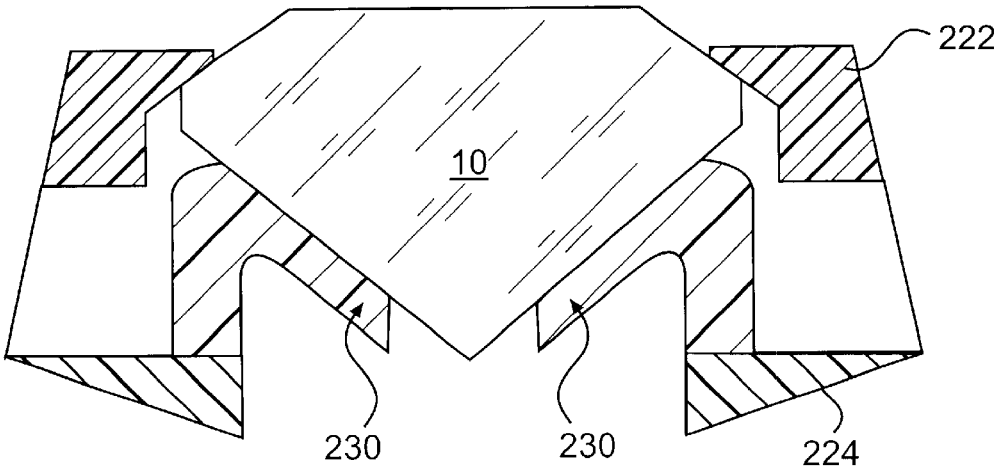
FIG. 9 is a cross-sectional view of yet another exemplary embodiment of the present invention.

FIG. 9 shows another alternative embodiment wherein a plurality of mounting members 230 are formed separate from the first member 222 and the second member 224. The plurality of mounting members 230 may be sandwiched between the second member 224 and an item 10, and the item 10 may be sandwiched between the plurality of mounting members 230 and the first member 222.

Although the exemplary embodiments shown in the drawings each show a single item mounted on either a fluid handling structure or a component associated with such a structure, numerous alternatives are possible. For example, certain aspects of the invention could be practiced to mount numerous items on a single structural assembly. Moreover, certain aspects of the invention could be practiced to mount items on structural arrangements unrelated to fluid handling. In particular, the mounting could be used for any type of cosmetic or care product.

It will be apparent to those skilled in the art that various modifications and variations can be made to the structure and methodology of the present invention. Thus, it should be understood that the invention is not limited to the embodiments and examples discussed in the specification. Rather, the present invention is intended to cover modifications and variations.

What is claimed is:

1. A device for mounting an item, comprising:

a first member comprising a portion defining at least one opening extending through the first member;

a second member intended to be fixed beneath the first member; and a plurality of mounting members associated with the second member, wherein the plurality of mounting members and the portion of the first member are configured to sandwich an item between the plurality of mounting members and the portion of the first member such that at least a portion of the item is arranged to be visible from an exterior of the device, and wherein the plurality of mounting members are configured to contact the item when the item is sandwiched between the mounting members and the portion of the first member.

2. The device of claim 1, wherein the second member comprises a portion defining a second opening, and wherein the opening defined by the first member is substantially aligned with the second opening.

3. The device of claim 1, wherein the first member comprises an outer surface and an inner surface, and at least a portion of the opening tapers in a direction facing from the inner surface to the outer surface thereby defining a seat facing the second member.

4. The device of claim 3, wherein the plurality of mounting members define a cradle, the cradle and the seat cooperating to define a region and being configured to sandwich an item in the region.

5. An arrangement including an item, comprising:

the device of claim 3; and an item configured to be sandwiched between the plurality of mounting members and the portion of the first member, wherein the item comprises a maximum width dimension greater than a minimum width dimension of the opening.

6. The arrangement of claim 5, wherein the item comprises a maximum width dimension less than a width dimension of the opening at the inner surface of the first member.

7. The device of claim 1, wherein the plurality of mounting members comprise at least three flexible fingers.

8. The device of claim 7, wherein each of the flexible fingers comprises a first portion extending from the second member toward the first member and a second portion extending from the first portion and having a free end.

9. The device of claim 8, wherein the second member comprises a portion defining a second opening, and wherein the second portion of each of the flexible fingers extends substantially toward the second opening.

10. An arrangement including an item, comprising:

the device of claim 1; and an item configured to be sandwiched between the plurality of mounting members and the portion of the first member.

11. The arrangement of claim 10, wherein a portion of the item extends at least partially through the opening.

12. The arrangement of claim 11, wherein at least the portion of the item is visible from the exterior of the device.

13. The arrangement of claim 10, wherein the plurality of mounting members comprise at least three flexible fingers.

14. The arrangement of claim 13, wherein each of the flexible fingers comprises a first portion extending from the second member toward the first member and a second portion extending from the first portion and having a free end.

15. The arrangement of claim 14, wherein the second member comprises a portion defining a second opening, and wherein the second portion of each of the flexible fingers extends substantially toward the second opening.

16. The arrangement of claim 10, wherein the portion of the first member defines a seat and the plurality of mounting members define a cradle, the item being sandwiched in a region defined by the seat and the cradle.

17. The arrangement of claim 16, wherein the first member comprises an outer surface and an inner surface, and at least a portion of the opening tapers in a direction facing from the inner surface to the outer surface thereby defining the seat.

18. The arrangement of claim 10, wherein the item comprises one of a jewel and a facsimile of a jewel.

19. The arrangement of claim 10, wherein the item comprises one of a natural stone and a synthetic stone.

20. The arrangement of claim 10, wherein the item comprises a cubic zirconium.

21. The arrangement of claim 20, wherein the item comprises a brilliant-cut diamond shape.

22. The arrangement of claim 10, wherein the arrangement comprises a closure member for a container.

23. The arrangement of claim 22, wherein the closure member is configured as a cap.

24. The arrangement of claim 22, wherein the first member comprises an outer cap portion and the second member comprises an inner cap portion, the inner cap portion being configured to be insertably mounted in the outer cap portion.

25. The arrangement of claim 24, wherein the outer cap portion and the inner cap portion are connected by an interference fit.

26. The arrangement of claim 22, wherein the closure member is configured as a stopper.

27. The arrangement of claim 10, wherein the arrangement comprises a cover configured to at least partially cover a container.

28. The arrangement of claim 27, wherein the first member comprises an outer sleeve and the second member comprises an inner sleeve, the outer sleeve being configured to at least partially surround the inner sleeve.

29. The arrangement of claim 10, wherein the plurality of mounting members are configured to bias the item toward the opening.

30. The arrangement of claim 10, wherein at least a portion of the item is visible from the exterior via the opening.

31. The device of claim 1, wherein the plurality of mounting members are configured to bias an item toward the opening.

32. An apparatus comprising:

an arrangement comprising a first member comprising a portion defining at least one opening extending through the first member;

a second member intended to be fixed beneath the first member;

a plurality of mounting members associated with the second member;

an item configured to be sandwiched between the plurality of mounting members and the portion of the first member, wherein the plurality of mounting members and the portion of the first member are configured to sandwich an item between the plurality of mounting members and the portion of the first member such that at least a portion of the item is arranged to be visible from an exterior of the device; and a container configured to contain a product, the arrangement being associated with the container.

33. The apparatus of claim 32, further comprising a product in the container.

34. The apparatus of claim 33, wherein the product comprises one of a cosmetic product and a care product.

35. The apparatus of claim 33, wherein the product comprises a fragrance.

36. The apparatus of claim 33, wherein the container comprises a pump, and wherein the arrangement is configured to cover an outlet of the pump.

37. The apparatus of claim 33, wherein the arrangement is configured as a stopper intended to be removably received by the container.

38. A closure member for a container, comprising:

an outer member defining at least one seat and at least one opening;

an inner member defining at least one cradle, the cradle and the seat cooperating to define a region; and an item mounted in the region defined by the seat and the cradle, wherein at least a portion of the item is visible from a side of the outer member opposite to the inner member.

39. The closure member of claim 38, wherein the outer member comprises an outer surface and an inner surface, and at least a portion of the opening tapers in a direction facing from the inner surface to the outer surface thereby forming the seat.

40. The closure member of claim 39, wherein the item comprises a maximum width dimension greater than a minimum width dimension of the opening.

41. The closure member of claim 40, wherein the item comprises a maximum width dimension less than a width dimension of the opening at the inner surface of the first member.

42. The closure member of claim 38, wherein the item comprises one of a natural stone and a synthetic stone.

43. The closure member of claim 38, wherein the item comprises a cubic zirconium.

44. The closure member of claim 43, wherein the item comprises a brilliant-cut diamond shape.

45. The closure member of claim 38, wherein the closure member is configured as a cap.

46. The closure member of claim 45, wherein the outer member comprises an outer cap portion and the inner member comprises an inner cap portion, the inner cap portion being configured to be mounted in the outer cap portion.

47. The closure member of claim 46, wherein the outer cap portion and the inner cap portion are connected by an interference fit.

48. The closure member of claim 38, wherein the closure member is configured as a stopper.

49. The closure member of claim 38, wherein a portion of the item extends at least partially through the opening.

50. An apparatus comprising:

the closure member of claim 38; and a container configured to contain a product.

51. The apparatus of claim 50, further comprising a product in the container.

52. The apparatus of claim 51, wherein the product comprises one of a cosmetic product and a care product.

53. The apparatus of claim 51, wherein the product comprises a fragrance.

54. A closure member for a container, comprising:

an outer member defining at least one seat and at least one opening;

an inner member defining at least one cradle, the cradle and the seat cooperating to define a region;

a plurality of mounting members associated with the inner member, the plurality of mounting members defining the cradle; and an item mounted in the region defined by the seat and the cradle.

55. The closure member of claim 54, wherein the plurality of mounting members comprise at least three flexible fingers.

56. The closure member of claim 55, wherein each of the flexible fingers comprises a first portion extending from the inner member toward the outer member and a second portion extending from the first portion and having a free end.

57. The closure member of claim 56, wherein the second member comprises a portion defining a second opening, and wherein the second portion of each of the flexible fingers extends substantially toward the second opening.

58. The closure member of claim 54, wherein the plurality of mounting members are configured to bias the item toward the opening.

59. A closure member for a container, comprising:

an outer member defining at least one seat and at least one opening;

an inner member defining at least one cradle, the cradle and the seat cooperating to define a region; and an item mounted in the region defined by the seat and the cradle, the item comprising one of a jewel and a facsimile of a jewel.

60. The closure member of claim 59, wherein at least a portion of the item is visible from an exterior of the closure member via the opening.

61. A product dispensing assembly, comprising:

a container configured to contain a product; and a portion associated with the container, the portion comprising:

a first member defining at least one seat and at least one opening, a second member defining at least one cradle, and an item mounted in a region defined by the cradle and the seat, wherein the second member defines a second opening, and wherein the opening defined by the first member is substantially aligned with the second opening.

62. A product dispensing assembly, comprising:

a container configured to contain a product; and a portion associated with the container, the portion comprising:

a first member defining at least one seat and at least one opening, a second member defining at least one cradle, and an item mounted in a region defined by the cradle and the seat, wherein the first member comprises an outer surface and an inner surface, and at least a portion of the opening tapers in a direction facing from the inner surface to the outer surface thereby defining the seat facing the second member.

63. The assembly of claim 62, further comprising a plurality of mounting members associated with the second member, the plurality of mounting members defining the cradle.

64. The assembly of claim 63, wherein the plurality of mounting members comprise at least three flexible fingers.

65. The assembly of claim 64, wherein each of the flexible fingers comprises a first portion extending from the second member toward the first member and a second portion extending from the first portion and having a free end.

66. The assembly of claim 65, wherein the second member defines a second opening, and wherein the second portion of each of the flexible fingers extends substantially toward the second opening.

67. The assembly of claim 63, wherein the plurality of mounting members are configured to bias the item toward the opening.

68. A product dispensing assembly, comprising:

a container configured to contain a product; and a portion associated with the container, the portion comprising:

a first member defining at least one seat and at least one opening, a second member defining at least one cradle, and an item mounted in a region defined by the cradle and the seat; wherein a portion of the item extends at least partially through the opening.

69. The assembly of claim 68, wherein the second member is intended to be fixed beneath the first member.

70. The assembly of claim 68, wherein at least the portion of the item is visible from an exterior of the assembly.

71. The assembly of claim 68, wherein the item comprises one of a jewel and a facsimile of a jewel.

72. The assembly of claim 68, wherein the item comprises one of a natural stone and a synthetic stone.

73. The assembly of claim 68, wherein the item comprises a cubic zirconium.

74. The assembly of claim 73, wherein the item comprises a brilliant-cut diamond shape.

75. The assembly of claim 68, wherein the portion comprises a closure member for the container.

76. The assembly of claim 75, wherein the closure member is configured as a cap.

77. The assembly of claim 76, wherein the first member comprises an outer cap portion and the second member comprises an inner cap portion, the inner cap portion being configured to be mounted in the outer cap portion.

78. The assembly of claim 77, wherein the outer cap portion and the inner cap portion are connected by an interference fit.

79. The assembly of claim 75, wherein the closure member is configured as a stopper.

80. The assembly of claim 79, wherein the stopper is configured to be removably inserted into the container.

81. The assembly of claim 68, wherein the container comprises a pump.

82. The assembly of claim 81, wherein the portion is configured to cover an outlet of the pump.

83. The assembly of claim 68, wherein the portion of the assembly forms a portion of the container.

84. The assembly of claim 83, wherein the portion of the assembly is configured as a cover configured to at least partially cover a part of the container defining a product reservoir.

85. The assembly of claim 84, wherein the first member comprises an outer sleeve and the second member comprises an inner sleeve, the outer sleeve being configured to at least partially surround the inner sleeve.

86. The assembly of claim 68, further comprising a product in the container.

87. The assembly of claim 86, wherein the product comprises one of a cosmetic product and a care product.

88. The assembly of claim 86, wherein the product comprises a fragrance.

89. The assembly of claim 68, wherein at least a portion of the item is visible from an exterior of the assembly via the opening.

90. A product dispensing assembly, comprising:

a container;

a cosmetic product contained in the container;

a cap comprising an outer member and an inner member, the cap being configured to be associated with the container; and an item sandwiched between the outer member and the inner member, at least a portion of the item being visible from an exterior of the assembly.

91. The assembly of claim 90, wherein the outer member defines at least one opening, a portion of the item extending at least partially through the opening.

92. The assembly of claim 91, wherein the inner member defines a second opening, and wherein the opening defined by the outer member is substantially aligned with the second opening.

93. The assembly of claim 90, wherein the inner member is intended to be fixed beneath the outer member.

94. The assembly of claim 90, wherein the outer member defines a seat and an opening, and the inner member defines a cradle, the item being sandwiched in a region defined by the cradle and the seat.

95. The assembly of claim 94, wherein the outer member comprises an outer surface and an inner surface, and at least a portion of the opening tapers in a direction facing from the inner surface to the outer surface thereby defining the seat.

96. The assembly of claim 95, further comprising a plurality of mounting members associated with the inner member, the plurality of mounting members defining the cradle.

97. The assembly of claim 96, wherein the plurality of mounting members comprise at least three flexible fingers.

98. The assembly of claim 97, wherein each of the flexible fingers comprises a first portion extending from the second member toward the first member and a second portion extending from the first portion and having a free end.

99. The assembly of claim 98, wherein the second member defines a second opening, and wherein the second portion of each of the flexible fingers extends substantially toward the second opening.

100. The assembly of claim 96, wherein the plurality of mounting members are configured to bias the item toward the opening.

101. The assembly of claim 90, wherein the item comprises one of a jewel and a facsimile of a jewel.

102. The assembly of claim 90, wherein the item comprises one of a natural stone and a synthetic stone.

103. The assembly of claim 90, wherein the item comprises a cubic zirconium.

104. The assembly of claim 103, wherein the item comprises a brilliant-cut diamond shape.

105. The assembly of claim 90, wherein the outer member comprises an outer cap portion and the inner member comprises an inner cap portion, the inner cap portion being configured to be mounted in the outer cap portion.

106. The assembly of claim 105, wherein the outer cap and the inner cap are connected by an interference fit.

107. The assembly of claim 90, wherein the container comprises a pump.

108. The assembly of claim 107, wherein the cap is configured to cover an outlet of the pump.

109. The assembly of claim 90, wherein at least a portion of the item is visible from the exterior via the opening.

110. A device for mounting an item, comprising:

a first member comprising a portion defining at least one opening extending through the first member; and a plurality of mounting members intended to be fixed beneath the first member, the plurality of mounting members being spaced from one another, wherein the plurality of mounting members and the portion of the first member are configured to sandwich an item between the plurality of mounting members and the portion of the first member such that at least a portion of the item is arranged to be visible from an exterior of the device, and wherein the plurality of mounting members are configured to contact the item when the item is sandwiched between the mounting members and the portion of the first member.

111. The device of claim 110, wherein the plurality of mounting members are arranged to define at least one second opening, and wherein the opening defined by the first member is substantially aligned with the second opening.

112. The device of claim 110, wherein the first member comprises an outer surface and an inner surface, and at least a portion of the opening tapers in a direction facing from the inner surface to the outer surface thereby defining a seat facing the plurality of mounting members.

113. The device of claim 112, wherein the plurality of mounting members define a cradle, the cradle and the seat cooperating to define a region and being configured to sandwich an item in the region.

114. An arrangement including an item, comprising:

the device of claim 112; and an item configured to be sandwiched between the plurality of mounting members and the portion of the first member, wherein the item comprises a maximum width dimension greater than a minimum width dimension of the opening.

115. The arrangement of claim 114, wherein the item comprises a maximum width dimension less than a width dimension of the opening at the inner surface of the first member.

116. The device of claim 110, wherein the plurality of mounting members comprise at least three flexible fingers.

117. The device of claim 116, further comprising a second member, at least one of the flexible fingers being associated with the second member.

118. The device of claim 117, wherein each of the flexible fingers comprises a first portion extending from the second member toward the first member and a second portion extending from the first portion and having a free end.

119. The device of claim 118, wherein the second member comprises a portion defining a second opening, and wherein the second portion of each of the flexible fingers extends substantially toward the second opening.

120. The device of claim 116, wherein the flexible fingers extend from said portion of the first member defining the opening.

121. An arrangement including an item, comprising:

the device of claim 110; and an item configured to be sandwiched between the plurality of mounting members and the portion of the first member.

122. The arrangement of claim 121, wherein a portion of the item extends at least partially through the opening.

123. The arrangement of claim 122, wherein at least the portion of the item is visible from the exterior of the device.

124. The arrangement of claim 121, wherein the plurality of mounting members comprise at least three flexible fingers.

125. The arrangement of claim 124, further comprising a second member, at least one of the flexible fingers being associated with the second member.

126. The arrangement of claim 125, wherein each of the flexible fingers comprises a first portion extending from the second member toward the first member and a second portion extending from the first portion and having a free end.

127. The arrangement of claim 126, wherein the second member comprises a portion defining a second opening, and wherein the second portion of each of the flexible fingers extends substantially toward the second opening.

128. The arrangement of claim 124, wherein the flexible fingers extend from said portion of the first member defining the opening.

129. The arrangement of claim 121, wherein the portion of the first member defines a seat and the plurality of mounting members define a cradle, the item being sandwiched in a region defined by the seat and the cradle.

130. The arrangement of claim 129, wherein the first member comprises an outer surface and an inner surface, and at least a portion of the opening tapers in a direction facing from the inner surface to the outer surface thereby defining the seat.

131. The arrangement of claim 121, wherein the item comprises one of a jewel and a facsimile of a jewel.

132. The arrangement of claim 121, wherein the item comprises one of a natural stone and a synthetic stone.

133. The arrangement of claim 121, wherein the item comprises a cubic zirconium.

134. The arrangement of claim 133, wherein the item comprises a brilliant-cut diamond shape.

135. The arrangement of claim 121, wherein the arrangement comprises a closure member for a container.

136. The arrangement of claim 135, wherein the closure member is configured as a cap.

137. The arrangement of claim 135, wherein the first member comprises an outer cap portion and the plurality of flexible fingers are associated with an inner cap portion, the inner cap portion being configured to be insertably mounted in the outer cap portion.

138. The arrangement of claim 137, wherein the outer cap portion and the inner cap portion are connected by an interference fit.

139. The arrangement of claim 135, wherein the closure member is configured as a stopper.

140. The arrangement of claim 121, wherein the arrangement comprises a cover configured to at least partially cover a container.

141. The arrangement of claim 140, wherein the first member comprises an outer sleeve configured to at least partially surround the container.

142. An apparatus comprising:

an arrangement comprising a first member comprising a portion defining at least one opening extending through the first member;

a plurality of mounting members intended to be fixed beneath the first member, the plurality of mounting members being spaced from one another; and an item configured to be sandwiched between the plurality of mounting members and the portion of the first member, wherein the plurality of mounting members and the portion of the first member are configured to sandwich an item between the plurality of mounting members and the portion of the first member such that at least a portion of the item is arranged to be visible from an exterior of the device; and a container configured to contain a product, the arrangement being associated with the container.

143. The apparatus of claim 142, further comprising a product in the container.

144. The apparatus of claim 143, wherein the product comprises one of a cosmetic product and a care product.

145. The apparatus of claim 143, wherein the product comprises a fragrance.

146. The apparatus of claim 143, wherein the container comprises a pump, and wherein the arrangement is configured to cover an outlet of the pump.

147. The apparatus of claim 143, wherein the arrangement is configured as a stopper intended to be removably received by the container.

148. A device comprising:

a container configured to contain a product; and a portion associated with the container, the portion comprising a first member defining at least one seat and at least one opening, at least one cradle comprising a plurality of mounting members, and an item mounted in a region defined by the cradle and the seat, the plurality of mounting members being configured to contact the item.

149. A device according to claim 148, wherein the first member comprises a portion defining the at least one opening extending through the first member.

150. A device according to claim 149, wherein the plurality of mounting members and the portion of the first member are configured to sandwich the item between the plurality of mounting members and the portion of the first member such that at least a portion of the item is arranged to be visible from an exterior of the device.

151. A device according to claim 148, wherein the plurality of mounting members are intended to be fixed beneath the first member.

152. A device according to claim 148, wherein the mounting members are spaced from one another.

153. A device according to claim 148, wherein the plurality of mounting members are arranged to define at least one second opening, and wherein the opening defined by the first member is substantially aligned with the second opening.

154. A device according to claim 148, wherein the first member comprises an outer surface and an inner surface, and at least a portion of the opening tapers in a direction facing from the inner surface to the outer surface thereby defining the seat facing the plurality of members.

155. A device according to claim 148, wherein the cradle is defined by a second member.

156. A device according to claim 155, wherein the second member is intended to be fixed beneath the first member.

157. A device according to claim 155, wherein the plurality of mounting members are associated with the second member.

158. A device according to claim 155, wherein the second member comprises a portion defining a second opening, and wherein the opening defined by the first member is substantially aligned with the second opening.

159. A device according to claim 155, wherein at least a portion of the item is visible from a side of the first member opposite to the second member.

160. A device according to claim 148, wherein at least a portion of the item extends at least partially through the opening.

* * * * *